United States Patent [19]

Bajer et al.

[11] 4,183,309

[45] Jan. 15, 1980

[54] BUTTONHOLE SEWING MACHINE FOR SEWING EYE OR STRAIGHT BUTTONHOLES WITH OR WITHOUT A WEDGE BAR TACK

[75] Inventors: František Bajer; Josef Nejedlý; Miloš Král, all of Prostejov, Czechoslovakia

[73] Assignee: Elitex, Koncern textilního strojírenství, Liberec, Czechoslovakia

[21] Appl. No.: 434

[22] Filed: Jan. 2, 1979

[30] Foreign Application Priority Data

Dec. 30, 1977 [CS] Czechoslovakia ..... 9049/77

[51] Int. Cl.[2] ..... D05B 3/06

[52] U.S. Cl. ..... 112/71; 112/70

[58] Field of Search ..... 112/65, 70, 71, 72, 112/158 B, 73

[56] References Cited

U.S. PATENT DOCUMENTS

| | | | |
|---|---|---|---|
| 1,565,241 | 12/1925 | Allen | 112/71 |
| 1,726,153 | 8/1929 | Kiewicz | 112/71 |
| 1,770,025 | 7/1930 | Connors | 112/71 |
| 2,149,110 | 2/1939 | Avis | 112/71 |
| 2,190,614 | 2/1940 | Spaine et al. | 112/71 |
| 2,477,941 | 8/1949 | Reece, Jr. et al. | 112/71 |

FOREIGN PATENT DOCUMENTS

| | | | |
|---|---|---|---|
| 1660845 | 10/1972 | Fed. Rep. of Germany | 112/65 |

*Primary Examiner*—H. Hampton Hunter

[57] ABSTRACT

There is disclosed a machine for selectively sewing four different kinds of buttonholes, i.e. (1) with an eye, (2) without an eye, (3) with a wedge bar tack, and (4) without a wedge bar tack. The machine accomplishes all of these different types of sewing with the use of only two shaped cams permanently arranged in the machine, the first of such cams being for sewing the eye, and the second of such cams being for sewing the bar tack. The machine has a support plate for the workpiece, such support plate being coupled with one end of a first two-armed lever the second end of which is formed as a pivot of a second two-armed lever whose first end is disengageably connected with the first cam. The second end of the second two-armed lever is disengageably connected with the second cam by way of further members comprising a rod which is rendered immobile in the disengaged position with respect to the overarm of the sewing machine.

3 Claims, 10 Drawing Figures

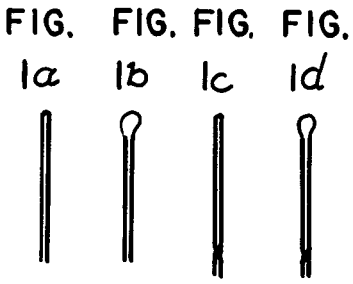
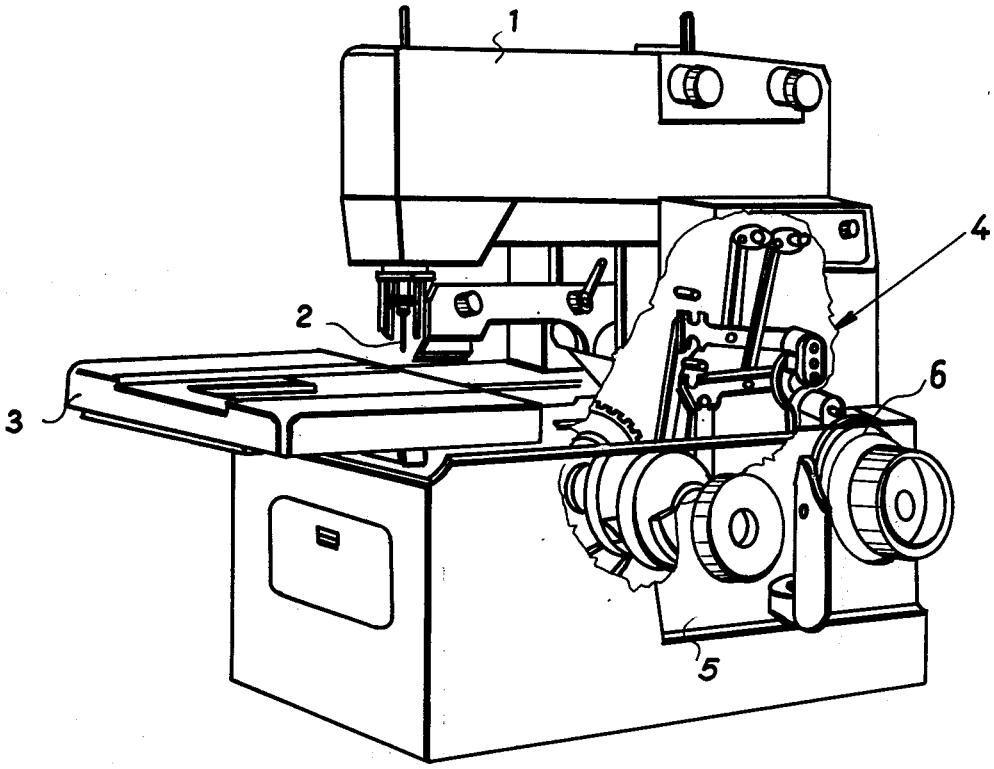
FIG-2

BUTTONHOLE SEWING MACHINE FOR SEWING EYE OR STRAIGHT BUTTONHOLES WITH OR WITHOUT A WEDGE BAR TACK

This application is related to the co-assigned application of Bajer et al, Ser. No. 11, filed Jan. 2, 1979, and Bajer et al., Ser. No. 435, filed Jan. 2, 1979.

The present invention relates to a buttonhole bar tacker sewing machine which makes possible the edge stitching of buttonholes in the simplest possible embodiment, without a thread eye and wedge bar tack, as well as the forming of buttonholes with a thread eye and a wedge bar tack in various combinations.

The usual sewing machines operate in such manner that the feeder continuously displaces the workpiece in one direction, and thus the needle punches form the straight stitch which consists of a row of plain or zigzag stitches. This principle cannot be applied in machines for bar tacking buttonholes, as it would be impossible to secure the bar tacking of the required buttonhole shape. Therefore, a support plate is used to which the workpiece is stationarily affixed by a pressing frame, and to which there is imparted from the control mechanism of the sewing machine a motion the resulting path of which coincides with the required shape of the buttonhole. Thus the required resulting contour of bar tacking the buttonhole arises of a system of zigzag stitches formed by repeated needle punches. In practice, to achieve this result there are employed cams the rotary motion of which is transmitted by transmission elements to the support plate, the cams having such shape that one revolution of the cam through 360°, that is back to its starting position, corresponds to the complete bar tacking of one buttonhole.

In the forming of the above-described different buttonholes 1–4, inclusive, exchangeable shaping cams of different shapes are employed. The disadvantages of sewing machines of this type, employing exchangeable shaping cams, of the type above described, are as follows:

1. Upon exchanging one shaping cam for another, it is necessary to secure with a high degree of accuracy, within the order of approximately 15 sec., the correct angular position of the newly mounted cam, otherwise the shape of the buttonhole eye would be non-symmetrical.

2. The permissible deviations of the shaping cam dimensions from a nominal size are extraordinarily small, since they would cause a non-symmetrical position of both bar tacked buttonhole sides relative to the cutting line of the buttonhole, and thus the danger of cutting the inner line of buttonhole stitches of one buttonhole row by the cuttting knife in the case of cutting the buttonhole after bar tacking the buttonhole. This disadvantage might be removed by adjusting further mechanisms of the machine. However, this time-consuming and professional skill requiring adjustment would have to be performed practically upon each shaping cam exchange.

3. The described prior art machines require that there be available a set of four shaping cams in order to make it possible to sew buttonholes of the various shapes 1–4, inclusive. As a result, this construction of buttonhole sewing machine is rather expensive.

The present invention has among its objects the mitigating of the disadvantages of the prior art and to provide a solution which makes it possible to sew buttonholes of configurations 1–4, inclusive, by using two permanently built-in shaping cams in the machine. In this manner, all of the above-described disadvantages of the prior art are overcome.

In a preferred embodiment of the sewing machine in accordance with the present invention the machine comprises a support plate for the workpiece and mechanism for imparting thereto the motion necessary for bar tacking the straight sides, the eye, and the wedge bar tack of the buttonhole. Such mechanisms comprise a cam for forming the eye of the buttonhole, and a cam for forming the wedge bar tack of the buttonhole. The said mechanisms comprise a first two-armed lever which is swingably mounted on a pivot cam immovable relative to the overarm of the sewing machine, one end of said lever being coupled in its movement via further transmission elements with a support plate, while the other end of said lever is made in the form of a pivot. A second two-armed lever has one end connected by an articulated joint with a first tie rod which is connected by a disengageable articulated joint with a first transmission lever which is coupled in its motion with the cam for forming the eye of the buttonhole, the second end of the second two-armed lever being connected by an articulated joint with a second tie rod which is disengageably connected by an articulated joint with the second transmission lever which is coupled in its motion with the cam for forming a wedge bar tack of the buttonhole. In the position of the first tie rod when disengaged from the first transmission lever, said first tie rod is rendered immovable relative to the overarm of the sewing machine, while in the position of the second tie rod when disengaged from the second transmission lever, said second tie rod is rendered immovable relative to the overarm of the sewing machine. The active surface of the cam for forming the eye of the buttonhole, as well as that of the cam for forming the wedge bar tack of the buttonhole, comprise on one hand sections which have a constant distance from the axis of rotation of the respective cam and comprise at least one further section which lies at a different distance from the axis of rotation of the cam.

The invention will be more readily understood upon consideration of the accompanying drawings showing a preferred embodiment of the sewing machine in accordance with the invention and the possibilities of application thereof, in which:

FIG. 1*a* is a diagram showing a first shape of buttonhole having no thread eye and no wedge bar tack;

FIG. 1*b* is a diagram showing a second shape of buttonhole having a thread eye and no wedge bar tack;

FIG. 1*c* is a diagram of a third shape of buttonhole having no thread eye but having a wedge bar tack;

FIG. 1*d* is a diagram of a fourth shape of buttonhole having a thread eye and a wedge bar tack;

FIG. 2 is a view in axonometric projection of a sewing machine in accordance with the present invention, certain parts of the housing of the machine being broken away for clarity of illustration;

FIG. 3 is a view in axonometric projection of the overall arrangement of the sewing machine mechanisms in accordance with the present invention;

Figure 5:
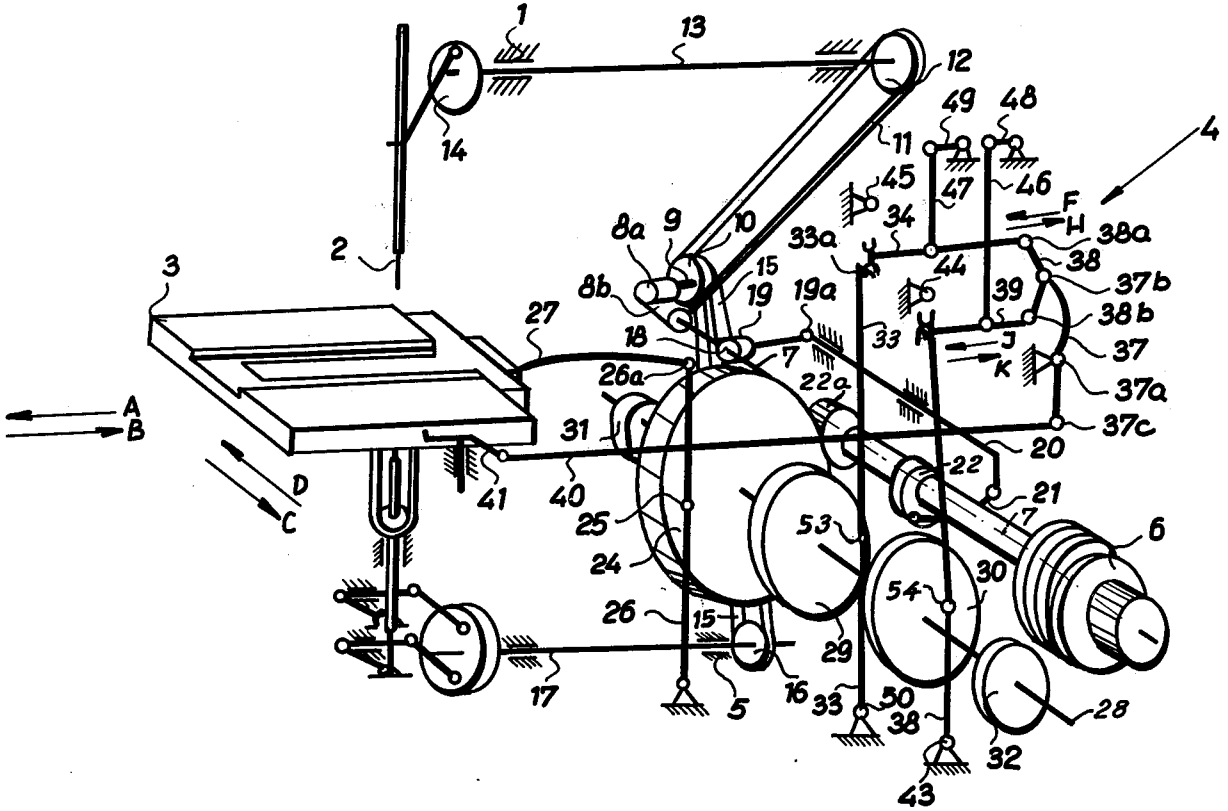
FIG. 5 is a diagrammatic representation of a cam 30 and the parts of the sewing machine associated therewith.

The buttonhole bar tacker sewing machine shown herein has an overarm 1 (FIG. 2) in which there are mounted mechanisms to be described below which impart to a needle 2 a motion currently encountered with normal zigzag stitch sewing machines.

The machine is further provided with a device known per se, by means of which in the eye forming phase of the buttonhole the stitch forming mechanism is turned selectively through an angle dictated by the required shape of the buttonhole eye c (FIG. 4) usually through 180°. This device, which secures the correct position of stitches in eye c of the buttonhole, has nothing to do with the correct operation in the present invention, and is therefore neither further described nor illustrated. Furthermore, the machine comprises a support plate 3, to which the sewn workpiece is fastened by a pressing frame which forms no part of the present invention and therefore is not shown. Moreover, the machine comprises the device according to the present invention, which is denoted as a whole by reference character 4 (FIG. 2) and which is to be described below in a detailed manner. The machine also comprises a housing 5 which is inserted with its bottom part in the base (not shown) of the sewing machine. A pulley 6 forms the main driving pulley of the whole machine, and is connected by a belt (not shown) to a prime mover (not shown) which may be for example an electric motor.

Turning now to FIG. 3, the basic driving pulley 6 is shown fixedly mounted on the main shaft 7 of the sewing machine, said shaft extending transversely thereof and being mounted in bearings (not shown). At the end of the shaft 7 distant from the pulley 6 shaft 7 is connected by helical gears 8*a*, 8*b* to a countershaft 9 to which is affixed a driving pulley 10 connected by a belt 11 to a pulley 12 affixed to a horizontal shaft 13 in the overarm of the machine and mounted in bearings, of which one is shown at 1'. An eccentric 14 affixed to the shaft 13 imparts a reverse vertical motion with a lateral component of the needle 2.

Figure 4:
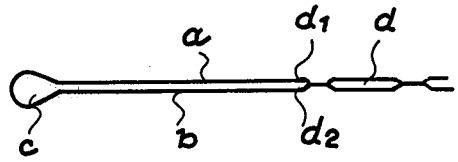
FIG. 4 is a diagrammatic representation of a buttonhole with an eye and a wedge bar tack.
Figure 5:
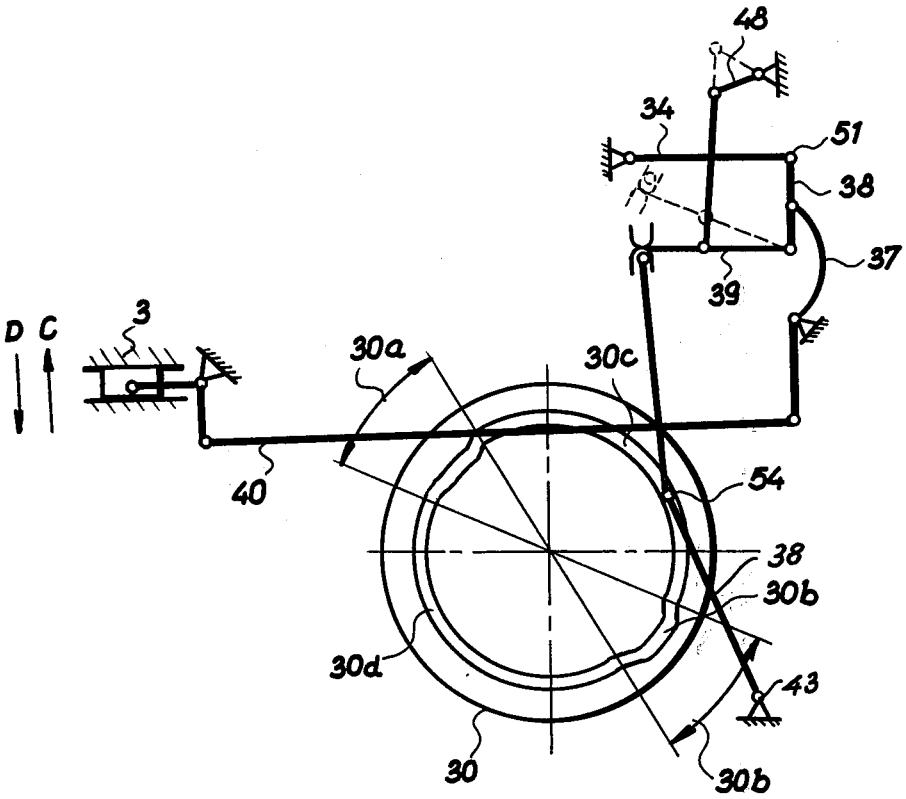

The driving pulley 10 is further connected by a belt 15 which is entrained over a pulley 16 affixed to a horizontal driving shaft 17 which imparts, via elements not specifically shown, a swinging motion to a looper (not shown) which participates with needle 2 in forming zigzag stitches. On main shaft 7 there is affixed a three-sided cam case 18 which is surrounded by a fork 19, the free end 19*a* of which is integral with the shaft 20. Shaft 20 is connected by a tie rod 21 by one of its parts to an over-running clutch 22 made in one piece with a gear 22*a* which is in permanent mesh with the teeth extending from the circumference of a grooved or box cam 24 having a cam track 24*a* in one side face thereof. A cam follower in the form of a pin 25 running in cam track 24*a* is affixed to a lever 26, the lower end of which is pivotally connected to a fixed support, as shown, and the upper end 26*a* of which is pivotally connected to a tie rod 27 which is pivotally connected to the support plate 3. Support plate 3 is thus given a reciprocating motion in the direction of the arrows A, B which is necessary for the edge stitching of the straight sides a, b of the buttonhole (FIG. 4).

Figure 6:
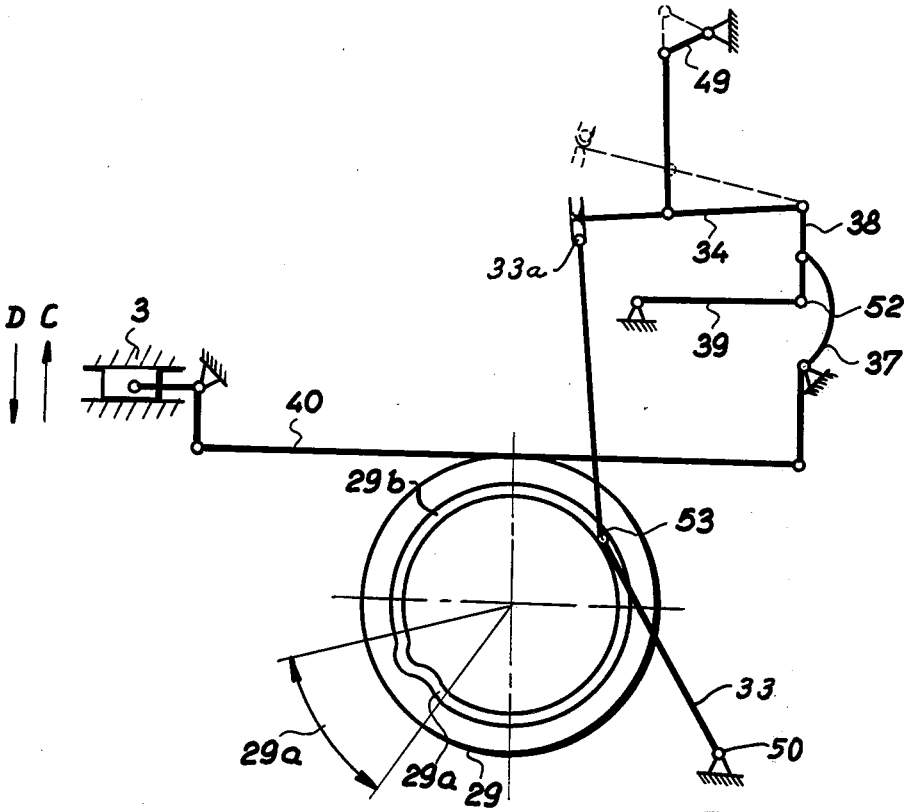
FIG. 6 is a diagrammatic representation of a cam 29 and of the various parts of the sewing machine associated therewith.

The cam 24 is affixed to a horizontal cam shaft 28. Mounted firmly upon shaft 28, but adjustable in its angular position relative to shaft 28, there are a cam 29 for forming the eye c of the buttonhole, and a cam 30 for forming the wedge bar tack d of the buttonhole. The shape of cams 29, 30 and their mutual angular position are shown in FIGS. 6 and 5, respectively. The section 29*a* of cam 29 is designed for edge stitching of eye c, sections 30*a*, 30*b* of cam 30 being designed to form both sections $d_1$, $d_2$ of the wedge bar tack d of the buttonhole.

As can be seen in FIGS. 5 and 6 of the drawings, cam 29 has at least one further section 29*b*, and cam 30 has at least one further section 30*c*, 30*d*, the distance of which from the axis of rotation of the respective cam is constant. The function of the sections 29*b*, 30*c* and 30*d* of the cams will be explained during the explanation of the manner of operation of the machine. A further cam 31 is firmly affixed to cam shaft 28, cam 31 being adapted to control cutting of the buttonhole. A still further cam 32 affixed to cam shaft 28 is adapted for stopping the sewing machine at the end of the edge stitching cycle of the buttonhole. Both said cams 31, 32 operate in a known manner, which does not relate to the present invention. Therefore their manner of operation and connection to the further mechanism of the machine are not further described.

As shown in FIGS. 3 and 6 a transmission lever 33, pivotally connected at 40 at its lower end to a fixed part of the machine has a cam follower pin 53 which extends into and follows the cam track in the cam 29. The upper end 33*a* of the transmission lever 33 is connected to a tie rod 34. Similarly, as shown in FIGS. 3 and 5, a further transmission lever 38, having its lower end pivotally connected at 43 to fixed structure, has a cam following pin 54 thereon constantly running in the cam groove of cam 30. As above noted, the transmission lever forms the wedge bar tack d of the buttonhole, the upper end of lever 38 being pivotally connected to a tie rod 39. The device further comprises a first two-armed lever 37, pivotally mounted at point 37*a* on a pivot pin (not shown) fixed in the overarm 1 of the sewing machine. One end 37*b* of the first two-armed lever 37 is made in the form of a pivot, on which there is pivotally mounted another two-armed lever 38, one end 38*a* of which is connected by an articulated joint to tie rod 34 by means of a pivotal connection 51 which passes through mutually coaxial cylindrical passages (not shown) made in the end 37*a* of the other two-armed lever 38 and in the end of tie rod 34. In a similar manner, the other end 38*b* of the other two-armed lever 38 is connected by an articulated joint to tie rod 39 by means of a pivot pin 52, which passes through mutually coaxial cylindrical passages (not shown) made on the one hand in the end 38*b* of the other two-armed lever 38, and on the other hand the end of tie rod 39. The other end 37*c* of the first two-armed lever 37 has an articulated joint with tie rod 40, which, in turn, is connected by an articulated joint to a bent lever 41 which is pivotally mounted on pin 42 introduced into the overarm 1 of the sewing machine and connected by an articulated joint with the support plate 3. As will be seen in the following description, the support plate 3 is further given a transverse reciprocal motion in the direction of the arrows C, D whereby the support 3 receives a transverse motion necessary for edge stitching the eye c and wedge bar tack d of the buttonhole during the operation of the machine.

The device comprises a further tie rod 46, which is connected by an articulated joint at one of its ends tie rod 39, and further tie 47, which is connected by an articulated joint at one of its ends to tie rod 34. The other end of tie rod 46 is connected by an articulated joint to one end first lever 48, the other end of which is fastened to a further, pivot (not shown) inserted into the overarm 1 of the machine. The device further comprises pivots 44, 45, which are stationarily mounted interiorally in the wall of the overarm 1 of the machine. The purpose of pivots 44, 45 will be more fully described below. Both change-over levers 48, 49 are extended outside the overarm 1 of the sewing machine.

In the diagram of FIG. 4 the shape of a buttonhole with an eye and a longitudinal bar tack is shown. The edge stichting of this buttonhole is made by zigzag stitches and consists of straight parts a, b, eye c, and bar tack d formed of two substantially parallel rows $d_1$, $d_2$.

As will follow from the further description below, the forming of a longitudinal bar tack d is possible under the presumption that the other transmission lever 36 performs a swinging motion about pivotal point 43, and that a movement connection is formed simultaneously between tie rod 39 and end 36*a* of the transmission lever 36. For that purpose, one end of tie rod 39 is provided with two opposite grooves 39*a*, 39*b*. The end 36*a* of the other transmission lever 36 disengageably engages groove 39*b*, while pivot 44 disengageably engages groove 39*a*, said pivot 44 blocking tie rod 39 against motion in the direction of arrows J, K (FIG. 3). By introducing end 36*a* into groove 39*b*, a movement in connection is established between the other transmission lever 36 and tie rod 39; in the opposite case, this movement connection is annulled.

Figure 7:
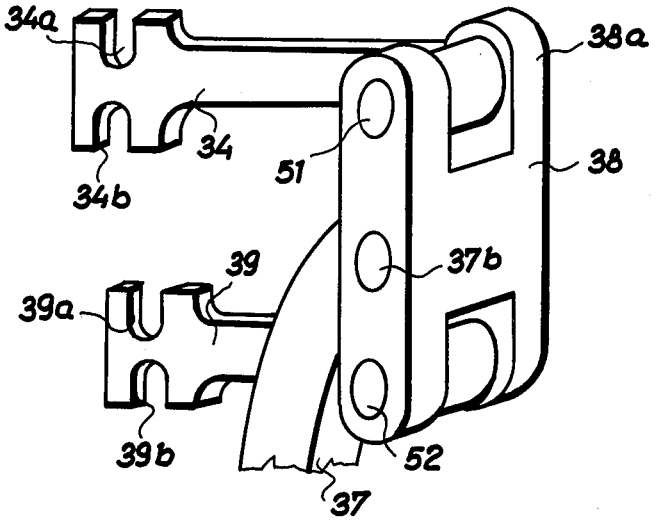
FIG. 7 is a view in axonometric projection of a further part of the sewing machine in accordance with the present invention.

It will also follow from the further description, that edge stitching of eye c is performed under the presumption that the first transmission lever 33 performs a swinging motion about pivot 50 and that a movement connection is established thereby between tie rod 34 and the end 33*a* of the first transmission lever 33. Similarly, as in the case of tie rod 39, one end of tie rod 34 is provided for that purpose with two opposite grooves 34*a*, 34*b*, as shown in FIG. 7. The end 33*a* of the first transmission lever 33 disengageably engages groove 34*b*, while pivot 45 disengageably engages groove 34*a*, said pivot locking tie rod 34 against motion in the direction of arrows F, H in FIG. 3. By introducing the end 33*a* into groove 34*b*, a movement connection is established between the first transmission lever 33 and tie rod 34; in the opposite case, this movement connection is annulled.

The above-described apparatus operates as follows:

Rotary motion is imparted to main pulley 6 of the machine from a prime mover (not shown). Such motion is then transmitted to main shaft 7, and from there via helical gears 8*a*, 8*b*, countershaft 9, driving pulley 10, driving belt 11, pulley 12 of the driving shaft 13, and eccentric 14 to needle 2, which is thereby, in connection with known mechanism, not shown, given the motion necessary for forming zigzag stitches. From the driving pulley 10 there is further imparted via driving belt 15 a motion to pulley 16 of driving shaft 17 of the looper (not shown).

Via the members described in the specification of the rest position of the device, tie rod 27 is given a motion in the direction of the arrows A, B, which is necessary for the edge stitching of straight parts a, b of the buttonhole, and which is derived from the shape of the grooved cam 24, which is not further described or shown, since it is formed by an arrangement known per se which is not related with this invention.

On shaft 28, cam 29 is firmly mounted for forming eye c of the buttonhole. By rotation of cam 29, motion is imparted to the first transmission lever 33, the tie rod 34, the second two-armed lever 38, i.e. a swinging motion about pivot 51, the first two-armed lever 37, the tie rod 40, the bent lever 41, and thus also in the direction of the arrows C, D to the support plate 3. By the combination of this motion with the motion of the support plate 3 in the direction of arrows A,B the eye c is then edge stitched to the required shape.

If edge stitching of the buttonhole without an eye c is required, it is necessary to disengage from operation the mechanism imparting motion to the support plate 3 in the direction of arrows C, D. For this purpose, the second change-over lever 49 is displaced from the position shown in full lines in FIG. 6 into the position shown therein in dash lines, in which the second change-over lever 49 is locked by a spring (not shown). Thus the movement coupling between tie rod 34 and the first transmission lever 33 is disengaged, tie rod 34 thus does not further receive the motion which which was formerly derived from the motion of support plate 3 in the direction of arrows C, D.

Cam 30, intended for edge stitching the wedge bar tack d of the buttonhole, imparts during the operation of the machine motion to the second transmission lever 36, tie rod 39, second two-armed lever 38, i.e., a swinging motion about pivot 52, the first two-armed lever 37, tie rod 40, bent lever 41, and thus also support plate 3 in the direction of arrows C, D. The angular displacement of cam 30 as well as of cam 29 on shaft 28 is chosen relative to grooved cam 28 in a known manner such that edge stitching of eye c as well as wedge bar tack d of the buttonhole takes place in the correct position relative to the straight sides a, b of the buttonhole.

If edge stitching of a buttonhole without a wedge bar tack d is required, it is necessary to disengage from operation the mechanism imparting a motion in the direction of arrows C, D to the support plate 3. For that purpose, the first change-over lever 48 as shown in FIG. 5 is displaced from the position represented in full lines to the position represented in dash lines, in which the first change-over lever 48 is locked by a spring (not shown). Thus the motion coupling between tie rod 39 and the second trnasmission lever 36 becomes disengaged, tie rod 39 thus no longer receiving the motion from which was formerly derived the motion of support plate 3 in the direction of arrows C, D.

It follows from the above specification, that the second two-armed lever 38 performs a swinging motion on time about pivot 51, and another time about pivot 52. For achieving the effect intended by the present invention, it is necessary that the pivot about which the second two-armed lever 38 performs a swinging motion, should in that phase be immobilized relative to overarm 1 of the machine, otherwise the required motion would not be transmitted to the support plate 3. Therefore, during the time when pivot 53 of the first transmission lever 33 is in contact with part 29*a* of cam 29, and when eye c of the buttonhole is thus formed, pivot 54 of the second transmission lever 36 is in contact with part 30*b* or 30*c* of cam 30, whereupon in the position of both change-over levers 48, 49 in full lines in FIGS. 5 and 6 pivot 52 is stopped. This stoppage is ended at the moment at which upon rotary motion of shaft 28 section 30*a* or 30*b* of cam 30 for edge stitching the bar tack d of the buttonhole comes into contact with pivot 54.

At the position of both change-over levers 48, 49 as just described, it follows further, that for the time for which pivot 54 of the second transmission lever 38 is in contact with parts 30*a* or 30*b* of cam 30, and when consequently parts $d_1$ or $d_2$ of the wedge bar tack d are thus formed, pivot 53 of the first transmission lever 33 is in contact with part 29*b* of cam 29 for edge stitching eye c of the buttonhole, pivot 51 thus being stopped until at the time at which section 29*a* of cam 29 comes into contact with pivot 53 upon rotary motion of shaft 33.

It follows therefrom, that both cams 29, 30 participate in edge stitching of the buttonhole not only by their active surfaces 29*a*, 30*a*, 30*b*, by means of which they form together the shape of eye c or of both sides $d_1$, $d_2$ of the wedge bar tack d of the buttonhole, but also with their cylindrical surfaces 29*b*, 30*c*, 30*d* as described above.

The specified embodiment in form of example admits a number of variations thereof. Thus, e.g. it is possible to make tie rod 34 immovable not only by cooperation of its groove 34*a* with pivot 45, but in any other suitable manner. It is also possible e.g. to make a transverse passage in tie rod 34, which would be engaged in the required position of tie rod 34, i.e. in that position in which the first transmission lever 33 is disconnected from cam 29 for forming eye c of the buttonhole, by a pivot (not shown) fixed in the overarm 1 of the sewing machine. This applies similarly to tie rod 39 and pivot 44. For the purpose of achieving the effect intended by the present invention, it is substantial that the appurtenant tie rod, i.e. either tie rod 34 or tie rod 39 be rendered immovable in the said position relative to overarm 1 of the sewing machine, irrespective of that by what means this immovability is achieved.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In a sewing machine for buttonhole bar tacking having an overarm, a support plate for the workpiece and mechanisms for imparting thereto motions necessary for bar tacking the straight sides, the eye and the wedge bar tack of the buttonhole, a first cam for forming the eye of the buttonhole, and a second cam for forming the wedge bar tack of the buttonhole, the improvement which comprises a first two-armed lever which is swingably mounted on a pivot immovable relative to the overarm of the sewing machine, one end of said first lever being coupled in its movement via further transmission elements with the support plate, while the other end of said first two-armed lever is made in the form of a pivot, a second two-armed lever of which one end is connected by an articulated joint with a first tie rod which is connected by disengageable articulated joint means with the first transmission lever coupled in its motion with the first cam for forming the eye of the buttonhole, the other end of the second two-armed lever being connected by an articulated joint with a second tie rod which is connected by an articulated joint disengageably with the second transmission lever which is coupled in its motion with the second cam for forming the wedge bar tack of the buttonhole, in the position of the first tie rod in which it is disengaged from the first transmission lever said first tie rod being rendered immovable relative to the overarm of the sewing machine, while in the position of the second tie rod when it is disengaged from the second transmission lever said second tie rod is rendered immovable relative to the overarm of the sewing machine, the active surface of the first cam for forming the eye of the buttonhole, as well as that of the second cam for forming the wedge bar tack of the buttonhole comprising sections which lie in a constant radial distance from the axis of rotation of the cam, each of said cams having at least one further section lying at a greater radial distance from the axis of rotation of the appurtenant cam.

2. A sewing machine for buttonhole bar tacking in accordance with claim 1, comprising two pivot pins arranged immovably with respect to the overarm of the sewing machine, the first pivot pin engaging upon the position of the first tie rod when disengaged from the first transmission lever groove formed in the first tie rod, while the second pivot pin engages a groove in the second tie rod upon the positioning of the second tie rod when it is disengaged from the second transmission lever.

3. A sewing machine for buttonhole bar tacking as claimed in claim 2, comprising a first change-over lever which extends outside the overarm of the sewing machine, said change-over lever being coupled in its motion with the first transmission lever, and a second change-over lever coupled in its motion with the second transmission lever.

* * * * *